US010131367B2

(12) United States Patent
Katahira et al.

(10) Patent No.: US 10,131,367 B2
(45) Date of Patent: Nov. 20, 2018

(54) STEERING BOGIE, AND VEHICLE FOR TRACK-BASED TRANSPORTATION SYSTEM

(71) Applicant: MITSUBISHI HEAVY INDUSTRIES, LTD., Tokyo (JP)

(72) Inventors: Kousuke Katahira, Tokyo (JP); So Tamura, Tokyo (JP); Mitsuaki Hoshi, Tokyo (JP); Masahisa Masukawa, Tokyo (JP)

(73) Assignee: MITSUBISHI HEAVY INDUSTRIES ENGINEERING, LTD., Yokohama-Shi, Kanagawa (JP)

( * ) Notice: Subject to any disclaimer, the term of this patent is extended or adjusted under 35 U.S.C. 154(b) by 310 days.

(21) Appl. No.: 14/915,467

(22) PCT Filed: Sep. 30, 2014

(86) PCT No.: PCT/JP2014/075995

§ 371 (c)(1),
(2) Date: Feb. 29, 2016

(87) PCT Pub. No.: WO2015/056560

PCT Pub. Date: Apr. 23, 2015

(65) Prior Publication Data

US 2016/0207548 A1 Jul. 21, 2016

(30) Foreign Application Priority Data

Oct. 18, 2013 (JP) ..... 2013-217737

(51) Int. Cl.
*B61F 5/38* (2006.01)
*B61F 9/00* (2006.01)
*B61B 13/00* (2006.01)

(52) U.S. Cl.
CPC ..... *B61F 5/38* (2013.01); *B61B 13/00* (2013.01); *B61F 9/00* (2013.01)

(58) Field of Classification Search
CPC .... B61F 5/38; B61F 5/383; B61F 5/52; B61F 13/00; B61F 13/12; B61F 9/00
See application file for complete search history.

(56) References Cited

U.S. PATENT DOCUMENTS 4,232,611 A * 11/1980 Uozumi ..... B62D 1/265 104/120
9,452,763 B2 * 9/2016 Maeyama ..... B62D 1/265
(Continued)

FOREIGN PATENT DOCUMENTS

FR 1302861 A 8/1962
JP S51-019401 U 2/1976
(Continued)

OTHER PUBLICATIONS

PCT/ISA/210, "International Search Report for International Application No. PCT/JP2014/075995," dated Dec. 22, 2014.
(Continued)

*Primary Examiner* — Jason C Smith
(74) *Attorney, Agent, or Firm* — Manabu Kanesaka; Benjamin Hauptman; Kenneth Berner

(57) ABSTRACT

This invention is equipped with: a steering shaft provided to an underframe of a carbody of a vehicle travelling on a traveling road surface of tracks; king pins provided as a pair to end sections of the steering shaft at both sides in the width direction; axle hubs swingably provided to the steering shaft via the king pins; tires mounted plurally to each of the axle hubs; guide wheels, which roll over guide rails provided to the tracks in the direction of extension of the tracks, and which are guided from the width direction of the tracks; a guide device part for supporting the guide wheels and the steering shaft; and a steering mechanism for causing the axle hubs to turn about the king pins in accordance with the displacement of the guide device part.

8 Claims, 9 Drawing Sheets

(56) References Cited

U.S. PATENT DOCUMENTS

| | | | | |
|---|---|---|---|---|
| 9,849,892 | B2 * | 12/2017 | Tachibana | B61F 9/00 |
| 9,919,720 | B2 * | 3/2018 | Yanobu | B61F 5/38 |
| 2005/0139117 | A1 * | 6/2005 | Ralph | B61F 9/00 105/168 |
| 2007/0113754 | A1 * | 5/2007 | Andreasson | B61B 13/00 104/242 |
| 2012/0000391 | A1 * | 1/2012 | Maeyama | B61F 9/00 105/182.1 |
| 2012/0031298 | A1 * | 2/2012 | Kurahashi | B61B 10/04 105/215.2 |
| 2012/0103227 | A1 * | 5/2012 | Maeyama | B61B 13/00 104/245 |
| 2015/0353104 | A1 * | 12/2015 | Maeyama | B61B 13/00 701/19 |
| 2016/0023671 | A1 * | 1/2016 | Tachibana | B61B 13/00 105/216 |
| 2016/0207548 | A1 * | 7/2016 | Katahira | B61B 13/00 |
| 2016/0251002 | A1 * | 9/2016 | Katahira | B61B 13/00 105/182.1 |
| 2016/0257315 | A1 * | 9/2016 | Yanobu | B61F 5/38 |
| 2016/0264156 | A1 * | 9/2016 | Yanobu | B61B 13/04 |
| 2016/0272222 | A1 * | 9/2016 | Katahira | B61B 13/00 |
| 2016/0304103 | A1 * | 10/2016 | Meyer | B61F 5/325 |
| 2016/0355059 | A1 * | 12/2016 | Katahira | B61F 9/00 |

FOREIGN PATENT DOCUMENTS

| | | | |
|---|---|---|---|
| JP | S53-038845 | B2 | 10/1978 |
| JP | S55-015301 | A | 2/1980 |
| JP | S58-011341 | B1 | 3/1983 |
| JP | S61-235202 | A | 10/1986 |
| JP | S63-112201 | A | 5/1988 |
| JP | H02-074201 | U | 6/1990 |
| JP | H02-059884 | B2 | 12/1990 |
| JP | H05-338534 | A | 12/1993 |
| JP | H06-312607 | A | 11/1994 |
| JP | 2558835 | Y2 | 1/1998 |
| JP | 2001-048007 | A | 2/2001 |
| JP | 2003-237571 | A | 8/2003 |
| JP | 2005-041257 | A | 2/2005 |
| JP | 2010-058618 | A | 3/2010 |
| JP | 4486696 | B1 | 6/2010 |
| JP | 2010-195057 | A | 9/2010 |
| JP | 4887235 | B2 | 2/2012 |
| JP | 4995217 | B2 | 8/2012 |

OTHER PUBLICATIONS

PCT/ISA/237, "Written Opinion of the International Searching Authority for International Application No. PCT/JP2014/075995," dated Dec. 22, 2014.

Japan Patent Office, "Office Action for Japanese Patent Application No. 2013-217737," dated Jun. 17, 2014.

Singapore Patent Office, "Office Action for Singaporean Patent Application No. 11201601520P," dated Sep. 8, 2016.

* cited by examiner

STEERING BOGIE, AND VEHICLE FOR TRACK-BASED TRANSPORTATION SYSTEM

TECHNICAL FIELD

The invention present relates to a steering bogie of a track-based transportation system, and a vehicle including the steering bogie.

Priority is claimed on Japanese Patent Application No. 2013-217737, filed Oct. 18, 2013, the content of which is incorporated herein by reference.

BACKGROUND ART

As new transportation means other than buses and railroads, track-based transportation systems in which a vehicle travels on a track using traveling wheels consisting of rubber tires, and guide wheels of the vehicle are guided by guide rails are known. Such track-based transportation systems are generally referred to as new transportation systems or automated people movers (APMs).

In the track-based transportation systems, there are some systems in which tires of a steering bogie can be steered so as to be capable of smoothly passing through a curved portion of the track when traveling on the curved portion of the track. A tire to be steered is generally a single tire in consideration of steering performance.

In this way, since the tire to be steered is the single tire, it is necessary to support the load of the vehicle with the single tire. For this reason, the weight of the vehicle is limited, and application of a steering carriage to a large-sized vehicle is difficult. Additionally, in order to maximize the imposed load while using the single tire, a technique of enclosing nitrogen gas so that the internal pressure is raised as high as possible is used. This becomes a factor of an increase in costs.

Additionally, in the single tire, the imposed load per tire becomes large. Thus, there is also limitation to maximum speed, and the single tire is generally used in a speed zone of 80 km/h or less.

Here, PTL 1 discloses that dual tires are used as steering wheels in a steering device to be applied to an automobile. In this steering device, a difference in rotation traveling distance between a tire outside a curve and a tire inside the curve is absorbed by using a differential gear. By applying the structure of the dual tires disclosed in PTL 1 to the tires steered by the steering bogie of the track-based transportation systems, it is possible to increase the imposed load of the tires.

CITATION LIST

Patent Literature

[PTL 1] Japanese Unexamined Patent Application Publication No. 55-15301

SUMMARY OF INVENTION

Technical Problem

However, in the structure described in PTL 1, it is necessary to provide the differential gear. Therefore, the structure becomes complicated and large, and the necessity for selecting larger sizes than those of tires and wheels that are usually selected comes out. Therefore, this becomes a factor of an increase in costs.

The invention provides a steering bogie and a vehicle for a track-based transportation system that can obtain sufficient load bearing performance while holding down costs.

Solution to Problem

A steering bogie related to a first aspect of the invention includes a steering shaft provided at a lower cart of a carbody of a vehicle for a track-based transportation system traveling on a traveling road surface of a track; shaft-like king pins provided in pair at end sections of the steering shaft on both sides of the carbody in a width direction; axle hubs provided so as to be swingable with respect to the steering shaft via the king pins; a plurality of tires mounted on each of the axle hubs; guide wheels that roll on guide rails provided at the track in an extending direction of the track and that are guided from the width direction of the track; a guide device part that supports the guide wheels and the steering shaft; and a steering mechanism that causes the axle hubs to rotate around the king pins in accordance with the displacement of the guide device part.

In such a steering bogie, the plurality of tires are mounted on each axle hub. For this reason, compared to a case where each axle hub is provided with one tire, that is, a case of a single tire, the carbody with large weight can be supported. Since the weight of the carbody can be decentralized and supported by the plurality of tires in this way, the imposed load per tire can be made small.

Additionally, since the imposed load per tire is made small, it is also possible to raise the speed performance of the tires to a speed performance that the tires originally have, and traveling at 100 km/h or more is also possible. As the tires travel at their original speed performance (100 km/h or more) in this way, the time of running can be shortened, and thereby, improvements in service for passengers become possible. Additionally, it is also possible to extend and manage the track from urban areas with many short curves to suburban cities having long distances between stations, and a transportation system with broad applications can be supplied.

In the steering bogie related to a second aspect of the invention based on the first aspect, the king pin may be provided at an inclination angle of 0 degrees or more and 8 degree or less on the basis of a vertical line orthogonal to a traveling direction and the width direction of the carbody, and the axle hub may be provided to have the inclination angle.

In the steering bogie related to a third aspect of the invention based on the first aspect, the king pin may be provided at an inclination angle of 0 degrees or more and 1 degree or less on the basis of a vertical line orthogonal to a traveling direction and the width direction of the carbody, and the axle hub may be provided to have the inclination angle. Additionally, it is more preferable that this inclination angle is near 0 degrees.

In this way, the tires to be steered are provided at an inclination angle of 0 degrees or more, that is, positive inclination angle. Hence, a restoring force such that the vehicle runs straight can be exerted on the tires, and straight-running stability can be improved.

Additionally, the tires steered in this way are provided at a king pin inclination angle of 0 degrees or more and 8 degrees or less, preferably, at a king pin inclination angle that is 0 degrees or more and 1 degree or less and near 0 degrees. That is, since the inclination angle is made small, even if one axle hub is provided with the plurality of tires, a difference between radii from the centers of the tires to a traveling surface in the tires and a difference between reaction forces that are applied to the tires from the traveling surface can be made small between the plurality of tires that are mounted on each axle hub at the time of the steering of the tires. As a result, the partial wear occurring between the plurality of tires can be suppressed.

In the steering bogie related to a fourth aspect of the invention based on any one of the first to third aspects, in the king pin, the spacing between a central Position, on the traveling road surface, of a tire width that is a distance between an inside end surface in a tire located on an innermost side in the width direction among the plurality of tires in the same axle hub, and an outside end surface in a tire located on an outermost side in the width direction, and a point where a central axis of the king pin intersects the traveling road surface may be 50 mm or more and 350 mm or less.

In this way, when a so-called king pin offset amount is a distance near 50 mm to 350 mm and preferably 50 mm, steering torque at the time of the steering of the tires can be made small. As a result, since steering resistance becomes small, passage with a large (short curve) curvature is also possible, there is also no limitation to track linearity, and free track linear programming is possible. Additionally, since the steering resistance is small, the load applied to steering system parts becomes small, the steering system parts can be made small, and a lightweight steering bogie can be provided compactly.

In the steering bogie related to a fifth aspect of the invention based on any one of the first to fourth aspects, the guide wheels may be supported by a guide device part in front of and behind the tires.

Since the guide wheels are provided in front of and behind the tires, excessive centrifugal force (centrifugal force super-elevation) caused on the vehicle when traveling along a curved portion of the track can be applied to the guide wheels, and side slip does not occur in the tires. For this reason, even if each axle hub is provided with the plurality of tires, sufficient steering performance can be obtained.

In the steering bogie related to a sixth aspect of the invention based on the fifth aspect, the guide device part may include a guide frame that supports the guide wheels and is provided so as to be turnable with respect to the carbody, and the steering mechanism may include a steering member that is installed between each of the axle hubs and the guide frame and steers the tires in accordance with the displacement of the guide frame.

If the guide wheels are guided along the guide rail by the steering member when traveling on the curved portion of the track, the guide frame is turned with respect to the carbody, and the guide frame is displaced according to the traveling direction. The tires are steered by the steering member with the displacement of this guide frame. That is, a structure in which a steering type is combined with a bogie type is provided, and the entire steering bogie is not turned, but only the guide frame is turned. For this reason, turning with a smaller force is possible, and even if each axle hub is provided with the plurality of tires, sufficient steering performance can be obtained.

In the steering bogie related to a seventh aspect of the invention based on any one of the first to sixth aspects, in the plurality of tires in the same axle hub, air pressure may be higher in the tire provided on a side away from the king pin than in the tire provided on a king pin side.

When each axle hub is provided with the plurality of tires, a larger imposed load is generated, under the influence of rolling of the vehicle occurring due to a centrifugal force according on the vehicle at the time of curve traveling, on the outer wheel (the tire on the side away from the king pin) than on the inner wheel the tire on the king pin side) when traveling on the curved portion. For this reason, if air pressures are made equal to each other between the plurality of tires, the amount of deflection of the outer wheel becomes larger, and the load radius of the outer wheel becomes smaller. In this case, in the inner wheel and the outer wheel, traveling distance per rotation becomes smaller in the outer wheel than in the inner wheel, and the inner wheel slips. Moreover, at the time of traveling on the curved portion, the traveling distance per rotation of the outer wheel needs to become larger than that of the inner wheel, due to a difference in the radius of rotation of a curve, between the plurality of tires mounted on the axle hub located outside in the direction of the radius of the curve. However, since the numbers of rotations are the same in the inner wheel and the outer wheel, the traveling distances per rotation of the inner wheel and the outer wheel are the same, and the slip of the inner wheel is promoted in combination with the influence of the above-described centrifugal force.

In the present embodiment, even if the rolling of the vehicle generated by the centrifugal force acting on the vehicle is applied at the time of curve traveling by making the air pressure of the outer wheel higher than that of the inner wheel, the load radius of the outer wheel can be kept large, and the traveling distance per rotation of the outer wheel can be increased. Therefore, the partial wear between the inner wheel and the outer wheel can be suppressed by suppressing the slip of the inner wheel and suppressing the wear of the inner wheel.

When traveling on the curved portion, in the plurality of tires provided in the axle hub or the inner side of the curve, the imposed load is reduced due to the influence of the centrifugal force compared to the plurality of tires provided in the axle hub on the outer side of the curve. The amount of decrease of this imposed load in the outer wheel becomes larger than that in the inner wheel, in the plurality of tires on the inner side of the curve. Since air pressure in the outer wheel is made higher as described above, the amount of decrease of imposed load can be suppressed. Hence, in the plurality of tires on the inner side of the curve, the partial wear between the inner wheel and the outer wheel can be suppressed by suppressing the slip of the outer wheel and suppressing the wear of the outer wheel.

In the steering bogie related to an eight aspect of the invention based on any one of the first to seventh aspects, in the plurality of tires in the same axle hub, the dimension of the tire width may be larger in the tire provided on a side away from the king pin than in the tire provided on a king pin side.

By using a tire with a larger width than the inner wheel (the tire on the king pin side) as the outer wheel (the tire on the side away from the king pin), the outer wheel is not easily deformed, and the load radius of the outer wheel can be kept larger than that of the inner wheel. Therefore, the traveling distance per rotation of the outer wheel can be increased, the partial wear between the inner wheel and the outer wheel can be prevented by reducing the amount of slip of the inner wheel. Moreover, the amount of decrease of the imposed load of the outer wheel of the plurality of tires on the inner side of the curve can be suppressed, and the partial wear between the inner wheel and the outer wheel can be suppressed by suppressing the wear of the outer wheel.

In the steering bogie related to a ninth aspect of the invention based on any one of the first to eighth aspects, in the plurality of tires in the same axle hub, the dimension of the tire diameter may be larger in the tire provided on a side away from the king pin than in the tire provided on a king pin side.

By using a tire with a larger diameter than the inner wheel (the tire on the king pin side) as the outer wheel (the tire on the side away from the king pin), the load radius of the outer wheel can be kept larger than that of the inner wheel. Therefore, the traveling distance per rotation of the outer wheel can be increased, the partial wear between the inner wheel and the outer wheel can be prevented by reducing the amount of slip of the inner wheel. Moreover, the amount of decrease of the imposed load of the outer wheel of the plurality of tires on the inner side of the curve can be suppressed, and the partial wear between the inner wheel and the outer wheel can be suppressed by suppressing the wear of the outer wheel.

Moreover, by mounting a tire in a half-worn state in which the wear has proceeded, as the inner wheel with a smaller diameter, and mounting a new tire as the outer wheel, it is possible to make the diameter of the tires larger on the outer wheel than on the inner wheel. That is, a dimensional difference between the inner wheel and the outer wheel can be provided by tire rotation. Thus, it is possible to utilize the tires efficiently.

In the steering bogie related to a tenth aspect of the invention based on any one of the first to ninth aspects, the guide wheels may be guided by the guide rails provided in a pair on both left and right sides of the track in the width direction.

In the steering bogie that travels on a so-called side guide type track, the imposed load per tire can be made small.

In the steering bogie related to an eleventh aspect of the invention based on any one of the first to ninth aspects, the guide wheels may be guided by one guide rail provided on at a central position of the track in the width direction.

In the steering bogie that travels on a so-called center guide type track, the imposed load per tire can be made small.

Additionally, a vehicle for a track-based transportation system related to a twelfth aspect of the invention includes the steering bogie according to any one of the first to eleventh aspects; and a carbody having the steering bogie provided at a lower part thereof.

In the vehicle for such a track-based transportation system, the imposed load per tire can be made small by including the above steering bogie.

Advantageous Effects of Invention

In the above steering bogie and the above vehicle for the track-based transportation system, the plurality of tires is mounted on an end section of each axle hub, so that sufficient load bearing performance can be obtained while holding down costs.

DESCRIPTION OF EMBODIMENTS

First Embodiment

Hereinafter, a vehicle 1 related to a first embodiment of the invention will be described with reference to FIGS. 1 to 6.

Figure 1:
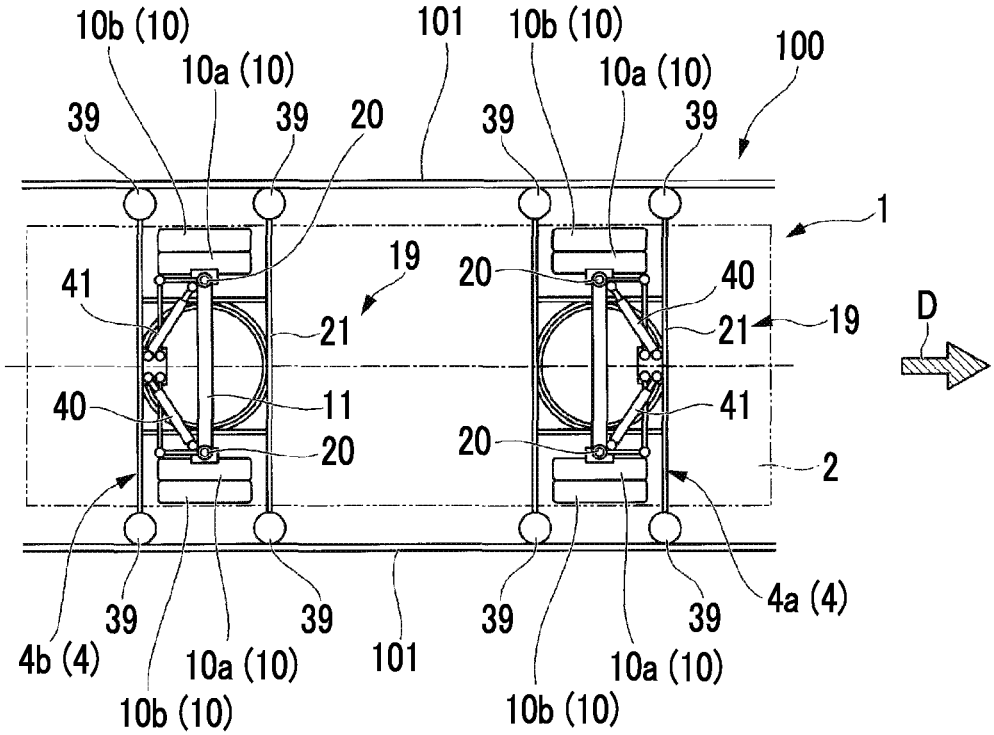
FIG. 1 is a top view illustrating an aspect in which a vehicle related to a first embodiment of the invention travels on a linear portion of a track.

As illustrated in FIG. 1, the vehicle 1 is a vehicle for a new transportation system that travels on a track 100 while being guided by a guide rail 101 provided at the track 100. In the present embodiment, the vehicle 1 is a vehicle for a side guide rail type (side guide type) transportation system in which guide rails 101 running along an extending direction of the track 100 are provided on both sides that come the outer sides of the track 100 in a width direction.

Additionally, the vehicle 1 includes a steering bogie 4 that travels or a traveling road surface 100*a* of the track 100, and a carbody 2 that is supported by the steering bogie 4.

The vehicle travels a direction (a rightward direction on the paper surface of FIG. 1) illustrated in arrow D of FIGS. 1, 2, 4, and 5. Hereinbelow, the front the rear facing in the traveling direction of the vehicle 1 are referred to as front and rear, and the left and right on a plane which intersects this traveling direction is referred to as left and right in the width direction.

The carbody 2 has a pair of steering bogies 4 provided on the front and rear in the traveling direction at a lower part thereof. Here, a steering bogie 4 provided on a front side referred to as a steering bogie 4*a*, and a steering bogie 4 provided on a rear side referred to as a steering bogie 4*b*.

Figure 2:
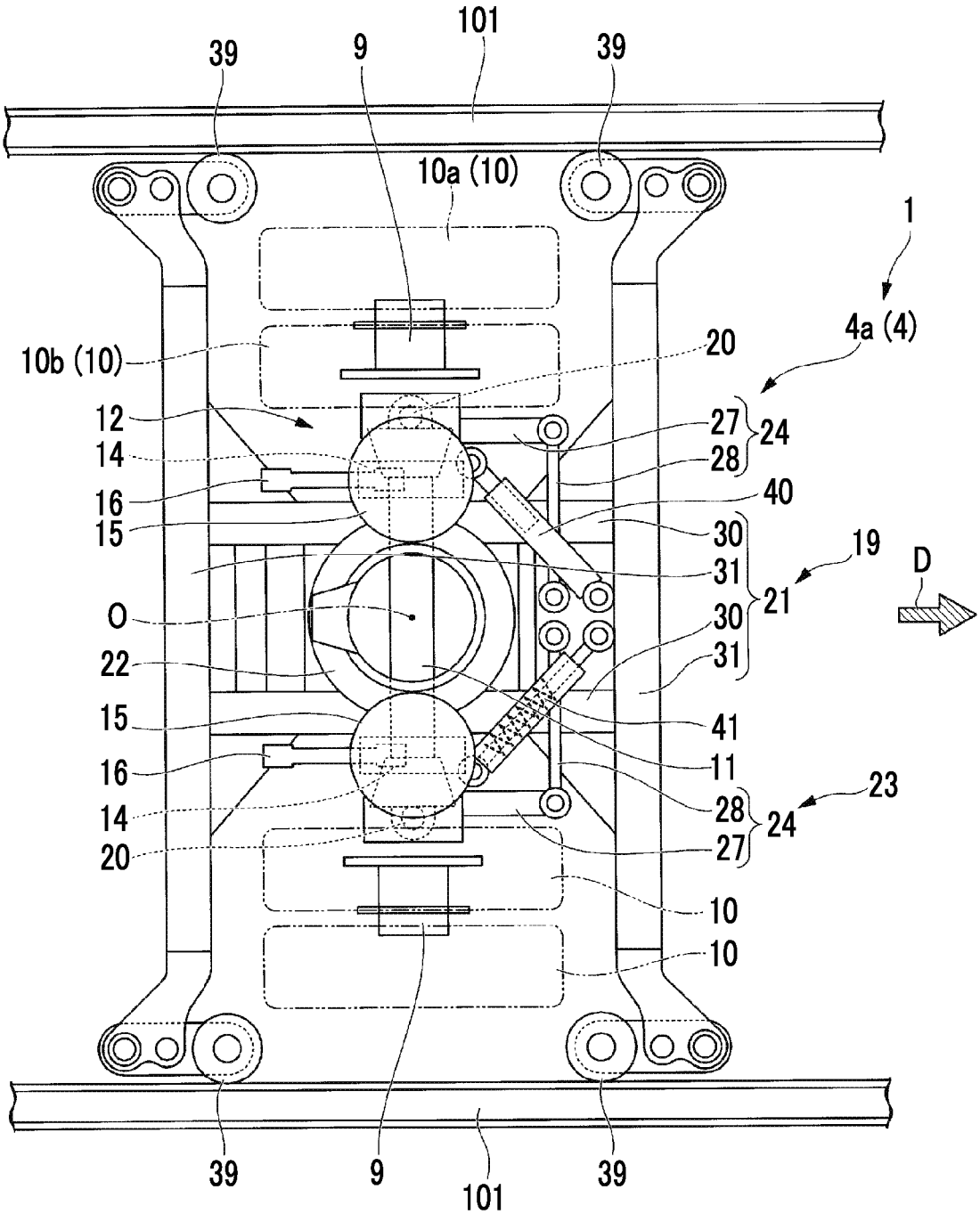
FIG. 2 is a top view illustrating a steering bogie provided at the vehicle related to the first embodiment of the invention.
Figure 3:
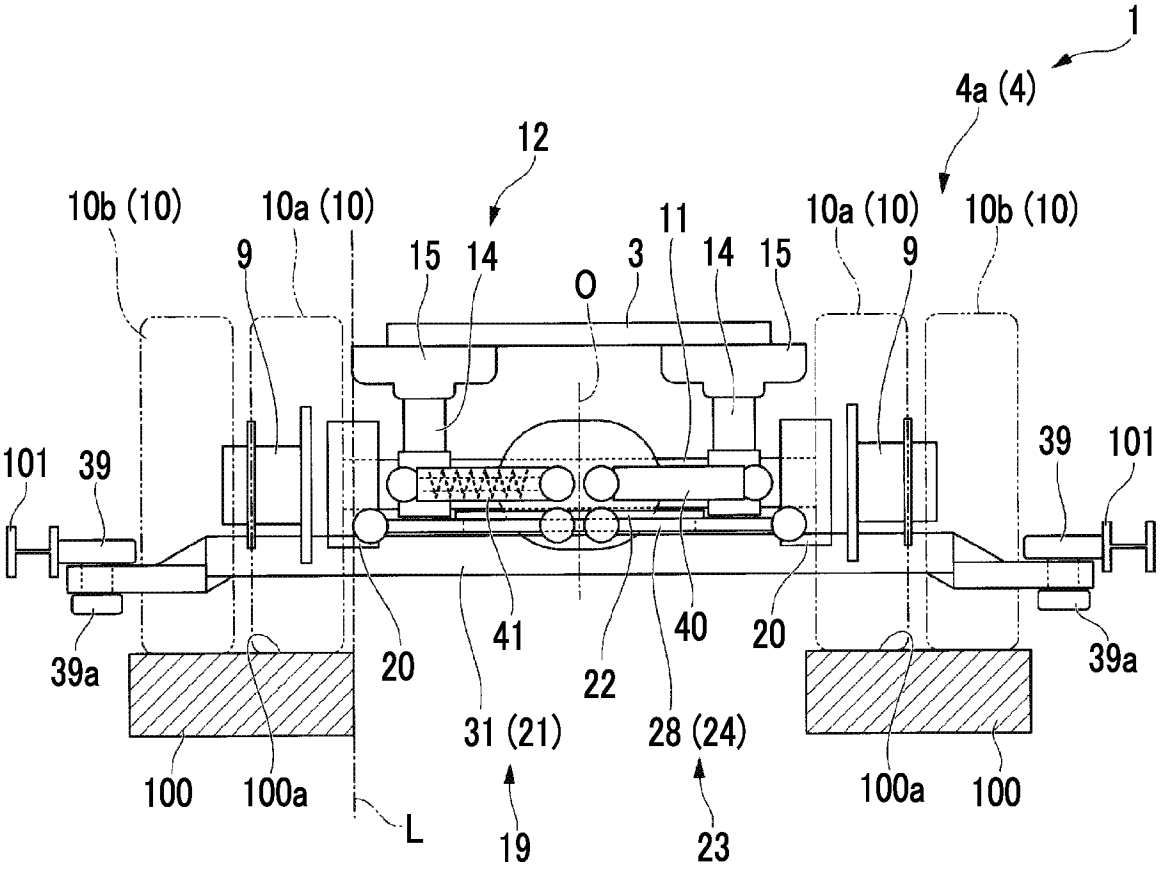
FIG. 3 is a front view illustrating the steering bogie provided at the vehicle related to the first embodiment of the invention.
Figure 4:
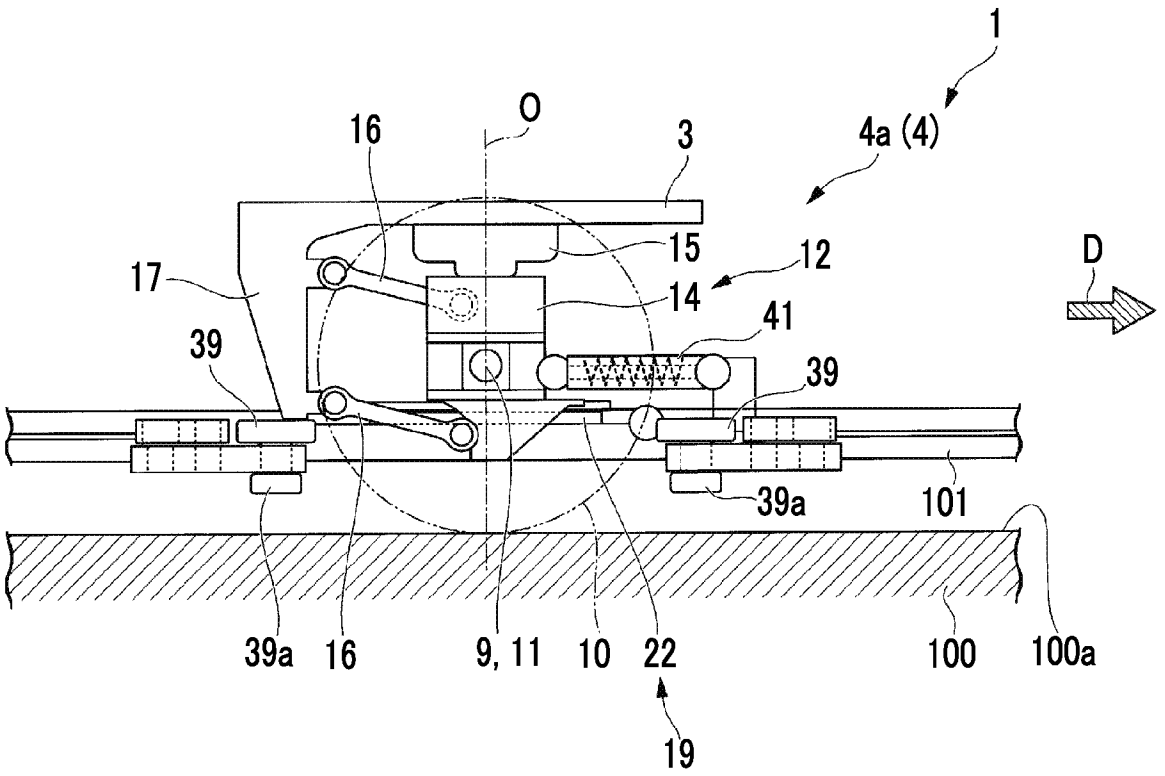
FIG. 4 is a side view illustrating the steering bogie provided at the vehicle related to the first embodiment of the invention.

As illustrated in FIGS. 2 to 4, each steering bogie 4 includes a steering shaft 11 provided at the lower part of the carbody 2, king pins 20 provided in one pair on both left and right sides in the width direction at end sections of the steering shaft 11, and axle hubs 9 provided at the steering shaft 11 via the king pins 20.

Moreover, the steering bogie 4 includes tires 10 mounted on the axle hubs 9, respectively, guide wheels 39 that are guided from the width direction of the track 100, a guide device part 19 that supports the guide wheels 39 and the steering shaft 11, and a steering mechanism 23 that steers the tires 10 in accordance with the displacement of the guide device part 19.

Here, since the steering bogie 4*a* on the front side and the steering bogie 4*b* on the rear side have the same configuration except that the front and rear are reversed, the steering bogie 4*a* on the front side will be representatively described below.

When the vehicle 1 is traveling on the linear portion of the track 100, the steering shaft 11 is provided so as to extend in the width direction.

The king pins 20 are members that serve as steering shafts of the tires 10 and form a shaft shape, and are provided in one pair on both sides in the width direction at an inclination angle of 0 degrees or more and 8 degrees or less on the basis of a vertical line L (refer to FIG. 3) orthogonal to the traveling direction and the width direction. The 8 degrees are positive 8 degrees, and indicate that a central axis L1 of each king pin. 20 inclines outward in the width direction as it moves downward (refer to FIG. 6).

The axle hub 9 are swingably provided so as to be swingable around the king pin 20 with respect to the steering shaft 11.

A plurality of tires 10 are mounted on each axle hub 9, and are swingable around the king pin 20 together with the steering shaft 11. The plurality of mounted tires 10 rotate with the same number of rotations as the axle hub 9 with the rotation of the axle hub 9.

In the present embodiment, two tires 10 are mounted on each axle hub 9, and are dual tires. Hereinafter, a tire 10 on the king pin 20 side out of the dual tires is referred to as an inner wheel 10*a*, and a tire 10 on a side moving away from the king pin 20 is referred to as an outer wheel 10*b*.

The guide wheels 39 are provided in four places on both left and right sides in the width direction so as to sandwich the tires 10 from the front and rear. The guide wheels 39 which are rotatable with rotational axes as centers extending upward and downward in an orthogonal direction orthogonal to the traveling direction and the width direction, come into contact with the guide rails 101 together with the traveling of the vehicle 1, and roll on the guide rails 101.

The guide device part 19 has a suspension device 12 that supports the steering shaft 11, a guide frame 21 that supports the guide wheels 39, and a turning bearing 22 that supports the guide frame 21 turnably around a turning center O perpendicular to a floor surface of the carbody 2.

The suspension device 12 has a pair of left and right spring receivers 14 that is brought into rigid contact with the steering shaft 11, a one pair of left and right air springs 15 that are arranged between an underframe 3 constituting the lower part of the carbody 2 and the spring receivers 14, a plurality of (four in the present embodiment) parallel links 16 that supports the spring receivers 14 so as to be displaceable in the orthogonal direction, and a suspension frame 17 that are disposed between the parallel links 16 and the underframe 3.

Each air spring 15 has an upper end mounted on the underframe 3 and has a lower end mounted on an upper end of each spring receiver 14. The air springs 15 relax the relative vertical vibration of the tires 10 with respect to the carbody 2.

The suspension frame 17 is located on rear sides of the spring receivers 14, and is fixed to the underframe 3. Since the front and rear of the steering bogie 4*b* on the rear side are reversed to those of the steering bogie 4*a* on the front side as described above, the suspension frame 17 is located on front sides of the spring receivers 14.

The parallel links 16 are vertically and horizontally arranged side by side so as to become parallel to each other, and couple the suspension frame 17 and the spring receivers 14. One end section of each of the parallel links 16 is pin-coupled to the suspension frame 17, and the other end section of each of the parallel links 16 is pin-coupled to the spring receiver 14. That is, the suspension frame 17, the spring receivers 14, and the parallel links 16 constitute a parallel link mechanism. The parallel links 16 also function as traction rods for transmitting driving forces or decelerating forces of the tires 10 to the carbody 2.

The guide frame 21 is arranged at lower parts of the spring receivers 14, and has a pair of left and right longitudinal beams 30 that extend in the traveling direction, and has a pair of cross beams 31 that are combined with the pair of longitudinal beams 30, extend outward in the width direction, and are disposed so as to be sandwich the tires 10 from the front and rear. The pair of longitudinal beams 30 and the pair of cross beams 31 are assembled in parallel crosses. Additionally, one guide wheel 39 as above is mounted on an end section position of each cross beam 31 in the width direction.

In the guide frame 21, a switching guide wheel 39*a* is provided below the guide wheel 39, rolls in contact with the branch guide rail (not illustrated) provided at the track 100, at a branching part in the track 100, and guides the vehicle 1 in a branch direction (refer to FIGS. 3 and 4).

Figure 5:
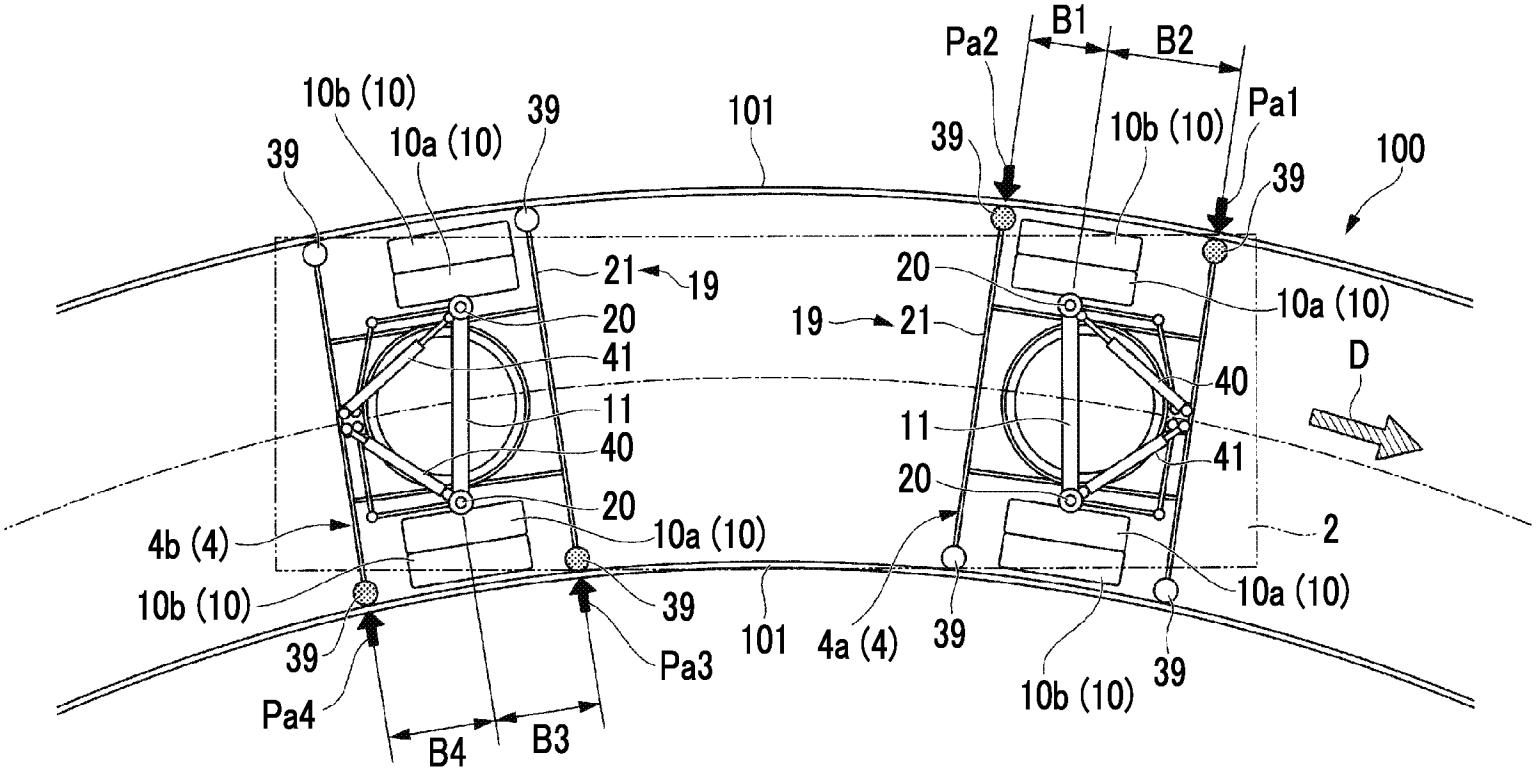
FIG. 5 is a top view illustrating an aspect in which the vehicle related to the first embodiment of the invention travels on a curved portion of the track.

The turning bearing 22 is arranged between of the pair of left and right the spring receivers 14 and the guide frame 21. Although the turning bearing 22 is not illustrated in details, the turning bearing has an inside ring and an outside ring. One of the inside ring and the outside ring is fixed to the lower parts of the pair of spring receivers 14 and the other is fixed to an upper part of the guide frame 21. In this way, as illustrated in FIG. 5, the guide frame 21 is made turnable with respect to the carbody 2. Forward-backward and leftward-rightward central parts of the guide frame 21 and a central part of the steering shaft 11 in the extending direction are located on the turning center O.

The steering mechanism 23 has steering members 24 that change the steering angle of the tires 10 in conjunction with the turning of the guide frame 21 around the turning center O, horizontal dampers 40 that damp forces acting on the tires 10, and steering stabilizers 41 that apply restoring forces to the tires 10.

Each steering member 24 has a steering arm 27 that rocks and rotates integrally with the tires 10 with the king pin 20 as a rotation center, and a steering rod 28 that couples the steering arm 27 and the guide frame 21.

The steering arm 27 is pin-coupled to each axle hub 9 so as to become rotatable with respect to the axle hub 9 with an axis extending in the orthogonal direction as a center. The steering arm 27 is provided so as to extend forward in a state where the vehicle 1 is traveling on the linear portion of the track 100.

The steering rod 28 is pin-coupled to a front end section of the steering arm 27 at one end section thereof. Additionally, the steering rod 28 is provided to extend inward in the width direction in a state where the vehicle 1 is traveling on the linear portion of the track 100. Additionally, the other end section of the steering rod 28 is pin-coupled to a central position of the guide frame 21 in the width direction. In this way, the steering rod 28 is rotatable with respect to the steering arm 27 and the guide frame 21 with an axis extending in the orthogonal direction as a center.

That is, if the guide frame 21 turns with the turning center O as a center, the steering rod 28 is displaced with this turning, rotates the axle hub 9 with the king pin 20 as a center via the steering arm 27, and steers the tires 10.

Each horizontal damper 40 is provided between one (left in the present embodiment) axle hub of the left and right axle hubs 9 and the guide frame 21, is a damping device, such as a pneumatic horizontal damper, and damps a force in a direction in which the tires 10 rotates around the king pin 20. More specifically, the horizontal damper 40 has one end pin-coupled to the guide frame 21 at the central position of the guide frame 21 in the width direction and at a position where the horizontal damper does not interfere with the steering rod 28 in front of a position where the steering rod 28 is pin-coupled. The other end of the horizontal damper 40 is pin-coupled to one of the left and right axle hubs 9. In this pin-coupled portion, one end and the other end of the horizontal damper 40 are made rotatable with the direction extending in the orthogonal direction as a rotational axis.

Each steering stabilizer 41 is provided between the other (right in the present embodiment) axle hub of the left and right axle hubs 9 and the guide frame 21, and applies a restoring force to return the tires 10 to a state before the rotation thereof to the tires 10, using a coil spring or the like, when the tires 10 have rotated around the king pin 20. More specifically, similar to the horizontal damper 40, the steering stabilizer 41 has one end pin-coupled to the guide frame at the central position of the guide frame 21 in the width direction and at a position where the horizontal damper does not interfere with the steering rod 28 in front of a position where the steering rod 28 is pin-coupled. Moreover, the other end of the steering stabilizer 41 is pin-coupled to the other of the left and right axle hubs 9. In this pin-coupled portion, one end and the other end of the steering stabilizer 41 are made rotatable with the direction extending in the orthogonal direction as a rotational axis.

In such a vehicle 1, as for each steering bogie 4, the plurality of tires 10 are mounted on each axle hub 9, and are dual tires in the present embodiment. For this reason, compared to a case where the each axle hub 9 is provided with one tire 10, that is, a case of a single tire, the carbody 2 with large weight can be supported.

Since the weight of the carbody 2 can be held by the dual tires in this way, the weight of the carbody 2 can be decentralized and supported, and the imposed load per tire 10 can be made small.

Therefore, it is also possible to return the speed performance of the tires 10 to an original speed performance that the tires 10 have, and traveling at 100 km/h or more is also possible. As the tires 10 travel at their original speed performance (100 km/h or more) in this way, the time of running can be shortened, and thereby, improvements in service for passengers become possible. It is also possible to extend the track 100 from urban areas with many short curves to suburban cities having long distances between stations, and a transportation system with broad applications can be supplied.

Additionally, since the imposed load per one tire 10 can be made small, for example, it is also possible to use tires 10 used for general trucks or general buses without using core-type tires 10.

In the core-type tires 10, exclusive jigs or exclusive tools are required at the time of the replacement of the tires 10, and replacement work is also difficult. Hence, since the tires used for general trucks or buses can be used as the tires 10, it is possible to reduce costs or reduce time and effort for the replacement work of the tires 10.

Moreover, the tires 10 to be steered are provided at an inclination angle of 0 degrees or more and 8 degrees or less. That is, since the inclination angle is made small, even in the dual tires, a difference between radii from the centers of the tires 10 to a traveling surface in the tires 10 and a difference between reaction forces that are applied to the tires 10 from the track 100 become small between the inner wheel 10*a* and the outer wheel 10*b* that are mounted on each axle hub 9 at the time of the steering of the tires 10. Hence, the partial wear between the tires 10 can be suppressed.

Additionally, since the tires 10 to be steered are provided at a positive inclination angle of 0 degrees or more, a restoring force such that the vehicle 1 runs straight can be exerted on the tires 10, and straight-running stability can be improved.

Although it is most preferable that the inclination angle of the king pin 20 is 0 degrees, since the influence of wear of steering system parts, the manufacturing dimension errors of the steering system parts, or the like can be considered in practice, it may be difficult to set the inclination angle to 0 degrees completely in terms of design. Hence, in the present embodiment, the inclination angle of the king pin 20 is set to 0 degrees or more and 8 degrees or less. However, the inclination angle may be 0 degrees or more and 5 degrees or less, preferably 0 degrees or more and 3 degrees or less, and more preferably 0 degrees or more and 1 degree or less. That is, it is preferable to bring the inclination angle as close to 0 degrees as possible in the range of dimensional tolerance.

When the inclination angle of the king pin 20 is set to 0 degrees or more and 1 degree or less, one angle that is an upper limit of this angle is a numerical value that is specified when the amount of lowering by which the inner wheel 10*a* and the outer wheel 10*b* constituting the dual tires 10 move downward at the time of steering becomes equal to or lower than a load radius difference $\Delta r$ between the inner wheel 10*a* and the outer wheel 10*b* that may occur due to wear in normal traveling.

The numerical value of the load radius difference $\Delta r$ that may be caused due to such wear in normal traveling is a numerical value that becomes 20% of the load radius difference caused between the inner wheel 10*a* and the outer wheel 10*b* due to a centrifugal force that is applied to the vehicle 1 at the time of traveling on a curved portion.

Additionally, since the guide wheels 39 are provided in front of and behind the tires 10, an excessive centrifugal force caused on the vehicle 1 when traveling on the curved portion of the track 100 can be applied to the guide wheels 39. For this reason, side slip is not caused in the tire 10, and even in the case of the dual tires, sufficient steering performance can be obtained.

Moreover, if the guide wheels 39 are guided by the guide rail 101, the guide frame 21 is displaced according to the traveling direction. With this displacement, the tires 10 are steered by the steering member 24 while the guide frame 21 is turned by the turning bearing 22 with respect to the carbody 2. Such a structure is a structure in which a steering type is combined with a bogie type, and the entire steering bogie 4 is not turned, but only the guide frame 21 is turned. For this reason, turning with a smaller force is possible by reducing turning weight, which leads to improvements in steering performance.

Here, as illustrated in FIG. 5, a the time of curve traveling, the steering bogie 4*a* (leading carriage) on the front side is guided to an outside rail side, and the steering bogie 4*b* (trailing carriage) on the rear side is brought into contact with and guided by the guide rail 101 on an inside rail side. In that case, a large guide wheel acting force as a steering force is applied to the guide wheel 39 on the front side in the steering bogie 4*a* on the front side, compared to the guide wheel 39 on the rear side. That is, "a guide wheel acting force on the front side: Pa1>a guide wheel acting force on the rear side: Pa2" is established. Additionally, a large guide wheel acting force as a steering force is applied to the guide wheel 39 on the front side in the steering bogie 4*b* on the rear side, compared to the guide wheel 39 on the rear side. That is, "a guide wheel acting force on the front side: Pa3>a guide wheel acting force on the rear side: Pa4" is established.

In a case where a steering type based on the steering mechanism using the king pin 20 and a guide frame turning mechanism is adopted as in the present embodiment, as for distances B1, B2, B3, and B4 from the centers (front and rear centers) of the tires 10 to the respective guide wheels 39, the distances B1 and P3 on the front side in the traveling direction become larger when running on the curved portion. Therefore, the guide wheel acting forces Pa1 and Pa3 are made smaller as compared to a rigid axle-type carriage with no kind pin 20.

The distance B1 is the distance between the guide wheel 39 on which the guide wheel acting force Pa1 acts and the centers of the tires 10, the distance B2 is the distance between the guide wheel 39 on which the guide wheel acting force Pa2 acts and the centers of the tires 10, the distance B3 is the distance between the guide wheel 39 on which the guide wheel acting force Pa3 acts and the centers of the tires 10, and the distance B4 is the distance between the guide wheel 39 on which the guide wheel acting force Pa4 acts and the centers of the tires 10.

If the dual tires are adopted as steering wheels, a larger steering force is required compared to a single tire. However, by making the guide wheel acting forces smaller as described above, steering performance can be maintained even in the dual tires. As a result, the durability of the guide wheels can also be improved.

Additionally, in the present embodiment, the steering arms 27 are provided on both left and right sides, and the guide frame 21 and each steering arm. 27 are coupled to the steering rod 28 at the central position thereof in the width direction.

By adopting such a structure, moment acting around the king pin 20 at the time of steering, which is caused by king pin offset, can be applied to the short steering rod 28, and the buckling strength at the time of the action of the compressive force of the steering rod 28. Therefore, steering errors or steering delay caused by the deflection of the steering rod 28 can be made small, and traveling stability at the time of high-speed running can be improved. Additionally, the steering rod 28 can be made thin and weight reduction is also possible.

Additionally, in a steering-type high-speed vehicle, steering adjustment work is the most important work. However, in this steering adjustment work, it is necessary to adjust the steering rod 28 and the steering stabilizer 41. In the present embodiment, since the steering rod 28 and the steering stabilizer 41 are provided on vehicle end sides (on the front side and the rear side in the traveling direction), the steering adjustment work can be performed in one place, and the steering adjustment work can be efficiently performed in a short time.

Additionally, the horizontal damper 40 and the steering stabilizer 41 can prevent the tires 10 from rocking around the king pin 20 when the vehicle 1 is traveling on the linear portion, and can improve straight-running stability.

According to the vehicle 1 of the present embodiment, by specifying the inclination angle of the king pin 20 in the tires 10 to be steered to 0 degrees or more and 8 degrees or less (preferably, 0 degrees or more and 1 degree or less) and by mounting the plurality of tires 10 to an end section of each axle hub 9, it is possible to obtain sufficient load bearing performance while holding down costs.

That is, the "deterioration of steering performance" that is a new problem occurs when it is intended to steer the dual tires. The above problem is solved by suppressing the inclination angle of the king pin 20 to 0 degrees or more and 8 degrees or less (preferably, 0 degrees or more and 1 degree or less) and by setting the offset amount of the king pin 20 to 50 mm or more and 350 mm or less.

Air pressures may be different from each other between the inner wheel 10*a* and the outer wheel 10*b* of the dual tires that are mounted on each axle hub 9 of the present embodiment. Specifically, the air pressure of the outer wheel 10*b* is made higher than that of the inner wheel 10*a*.

When the dual tires are adopted, the imposed load of the outer wheel 10*b* increases more than that of the inner wheel 10*a* due to the influence of the centrifugal force at the time of traveling on the curved portion. For this reason, when air pressures are made equal to each other between the inner wheel 10*a* and the outer wheel 10*b*, the amount of deflection of the outer wheel 10*b* becomes larger, and the load radius of the outer wheel 10*b* becomes smaller.

In this case, in the inner wheel 10*a* and the outer wheel 10*b*, traveling distance per rotation become smaller in the outer wheel 10*b* than in the inner wheel 10*a*, and the inner wheel 10*a* slips.

Moreover, at the time of traveling on the curved portion, the traveling distance per rotation of the outer wheel 10*b* needs to become larger than that of the inner wheel 10*a*, due to a difference in the radius of rotation of a curve, between the inner wheel 10*a* and the outer wheel 10*b* of the dual tires that are provided in the axle hub 9 located outside in the direction of the radius of the curve.

However, since the numbers of rotations are the same in the inner wheel 10*a* and the outer wheel 10*b*, the traveling distances per rotation of the inner wheel 10*a* and the outer wheel 10*b* are the same. As a result, the slip of the inner wheel 10*a* is promoted in combination with the influence of the above-described centrifugal force.

In the present embodiment, even if the centrifugal force is applied by making the air pressure of the outer wheel 10*b* higher than that of the inner wheel 10*a*, the load radius of the outer wheel 10*b* can be kept large, and the traveling distance per rotation of the outer wheel 10*b* can be increased. Therefore, the partial wear between the inner wheel 10*a* and the outer wheel 10*b* can be suppressed by suppressing the slip of the inner wheel 10*a* and suppressing the wear of the inner wheel 10*a*.

Moreover, when traveling on the curved portion, in the dual tires provided in the axle hub 9 on the inner side (the right side toward the paper surface of FIG. 5) of the curve, the imposed load is reduced due to the influence of the centrifugal force compared to the dual tires provided in the axle hub 9 on the outer side (left side toward the paper surface of FIG. 5) of the curve.

The amount of decrease of this imposed load in the outer wheel 10*b* becomes larger than that in the inner wheel 10*a*, in the dual tires on the inner side of the curve.

In the present embodiment, since the air pressure of the outer wheel 10*b* is made high, the amount of decrease of the imposed load of the outer wheel 10*b* caused by such influence of the centrifugal force can be suppressed. Hence, the partial wear between the inner wheel 10*a* and the outer wheel 10*b* can be suppressed by suppressing the slip of the outer wheel 10*b* in the dual tires on the inner side of the curve and suppressing the wear of the outer wheel 10*b*.

As a numerical value of a specific air pressure difference between the inner wheel 10*a* and the outer wheel 10*b*, the outer wheel 10*b* may be 1.1 times to 1.15 times of the inner wheel 10*a*. This numerical value is a numerical value such that a load radius difference caused by the difference in the imposed load between the inner wheel 10*a* and the outer wheel 10*b* of the dual tires can be absorbed when a vehicle for a track-based transportation system travels on the curved portion.

The width dimensions of the tires 10 may be different from each other between the inner wheel 10*a* and the outer wheel 10*b* of the dual tires that are mounted on each axle hub 9 of the present embodiment. Specifically, the width dimension of the tires 10 is made larger on the outer wheel 10*b* provided on a side away from the king pin 20 than on the inner wheel 10*a* provided on the king pin 20 side.

By using a tire 10 with a larger width than the inner wheel 10*a* as the outer wheel 10*b*, the outer wheel 10*b* is not easily deformed, and the load radius of the outer wheel 10*b* can be kept larger than that of the inner wheel 10*a*. Therefore, the traveling distance per rotation of the outer wheel 10*b* can be increased, and the partial wear between the inner wheel 10*a* and the outer wheel 10*b* can be prevented by reducing the amount of slip of the inner wheel 10*a*.

Moreover, the amount of decrease of the imposed load of the outer wheel 10*b* in the dual tires on the inner side of the curve can be suppressed, and the partial wear between the inner wheel 10*a* and the outer wheel 10*b* can be suppressed by suppressing the wear of the outer wheel 10*b*.

The diameter dimensions of the tires 10 may be different from each other between the inner wheel 10*a* and the outer wheel 10*b* of the dual tires that are mounted on each axle hub 9 of the present embodiment. Specifically, the diameter dimension of the tires 10 is made larger on the outer wheel 10*b* provided on the side away from the king pin 20 than on the inner wheel 10*a* provided on the king pin 20 side.

By using a tire 10 with a larger width than the inner wheel 10*a* as the outer wheel 10*b* in this way, the load radius of the outer wheel 10*b* can be kept larger than that of the inner wheel 10*a*. Therefore, the traveling distance per rotation of the outer wheel 10*b* can be increased, and the partial wear between the inner wheel 10*a* and the outer wheel 10*b* can be prevented by reducing the amount of slip of the inner wheel 10*a*. Moreover, the amount of decrease of the imposed load of the outer wheel 10*b* in the dual tires on the inner side of the curve can be suppressed, and the partial wear between the inner wheel 10*a* and the outer wheel 10*b* can be suppressed by suppressing the wear of the outer wheel 10*b*.

Moreover, by mounting a tire 10 in a half-worn state in which the wear has proceeded, as the inner wheel 10*a* with a smaller diameter, and mounting a new tire 10 as the outer wheel 10*b*, it is possible to make the diameter of the tires 10 smaller on the outer wheel 10*b* than on the inner wheel 10*a*. That is, a dimensional difference in diameter between the inner wheel 10*a* and the outer wheel 10*b* can be provided by tire rotation. Thus, it is possible to utilize the tires 10 efficiently.

Figure 6:
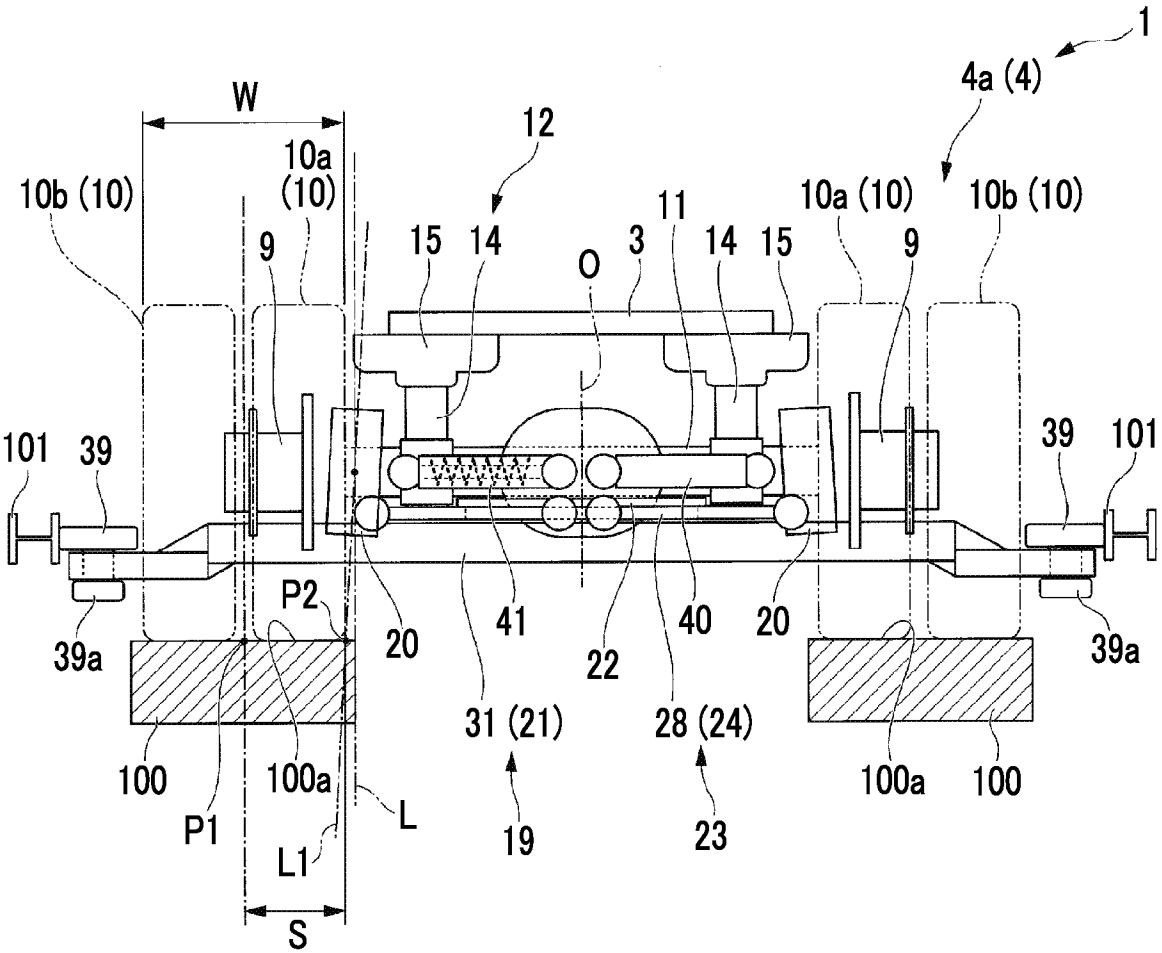
FIG. 6 is a top view illustrating the steering bogie provided at the vehicle related to the first embodiment of the invention and illustrating a case where a king pin has a positive inclination angle.

Here, as illustrated in FIG. 6, the central position, on a traveling road surface 100*a*, of a tire width W that is a distance between an inside end surface in the inner wheel 10*a* of the dual tires mounted on each axle hub 9 and an outside end surface in the outer wheel 10*b* of the dual tires is defined as P1. In this case, it is preferable that the spacing S between the central position P1 of the dual tires and a point P2 where the central axis L1 of the king pin. 20 intersects the traveling road surface 100*a* is 50 mm or more and 350 mm or less.

In this way, when a so-called king pin offset amount is a distance near 50 mm to 350 mm and more preferably 50 mm, steering torque at the time of the steering of the tires 10 can be made small. As a result, since steering resistance becomes small, passage with a large (short curve) curvature is also possible, there is also no limitation to track linearity, and free track linear programming is possible. Additionally, since the steering resistance is small, the load applied to the steering system parts becomes small, the steering system parts can be made small, and the steering bogie 4 can be made compact and lightweight.

Second Embodiment

Hereinafter, a vehicle 1A related to a second embodiment of the invention will be described with reference to FIGS. 7 to 9.

Figure 7:
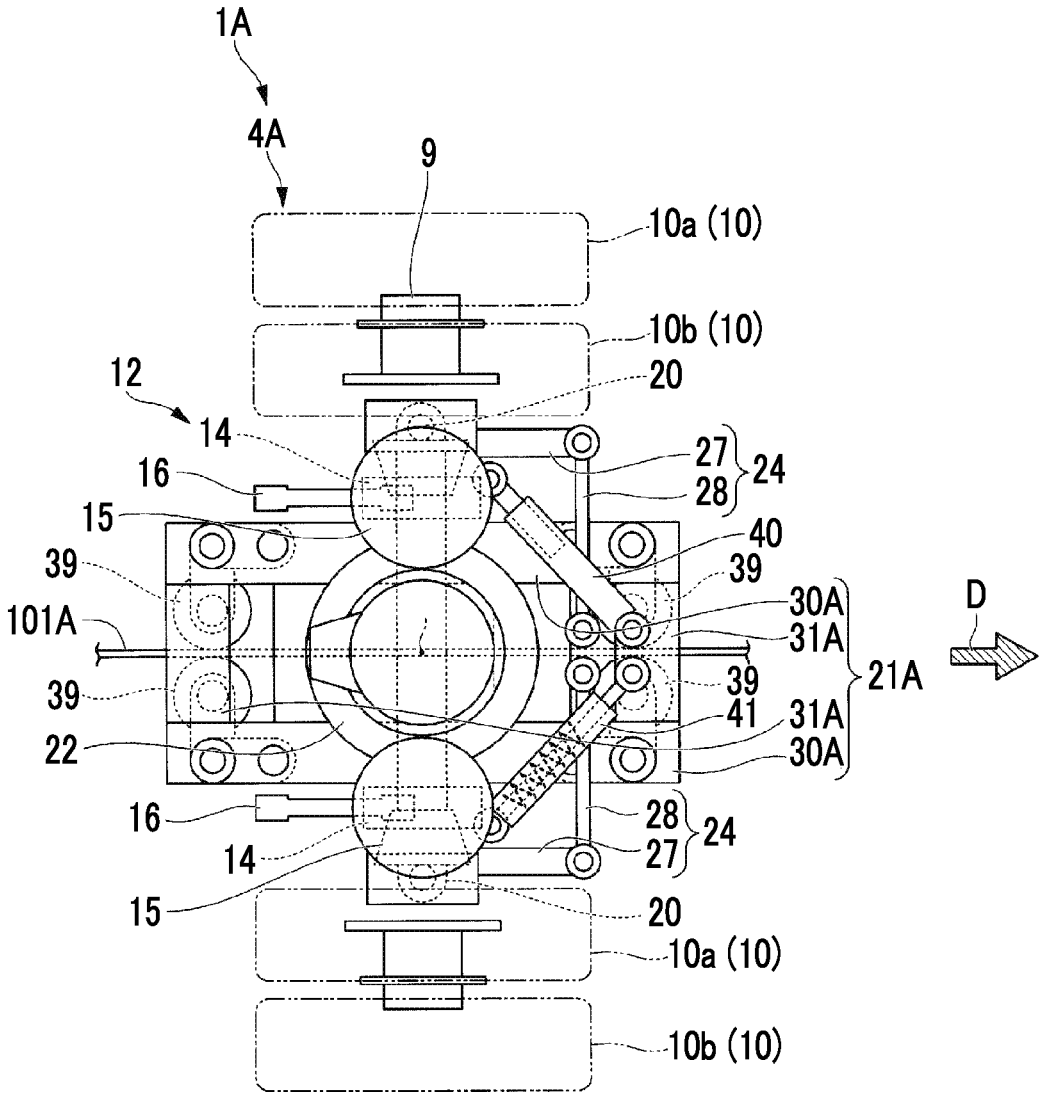
FIG. 7 is a top view illustrating a steering bogie provided at a vehicle related to a second embodiment of the invention.
Figure 8:
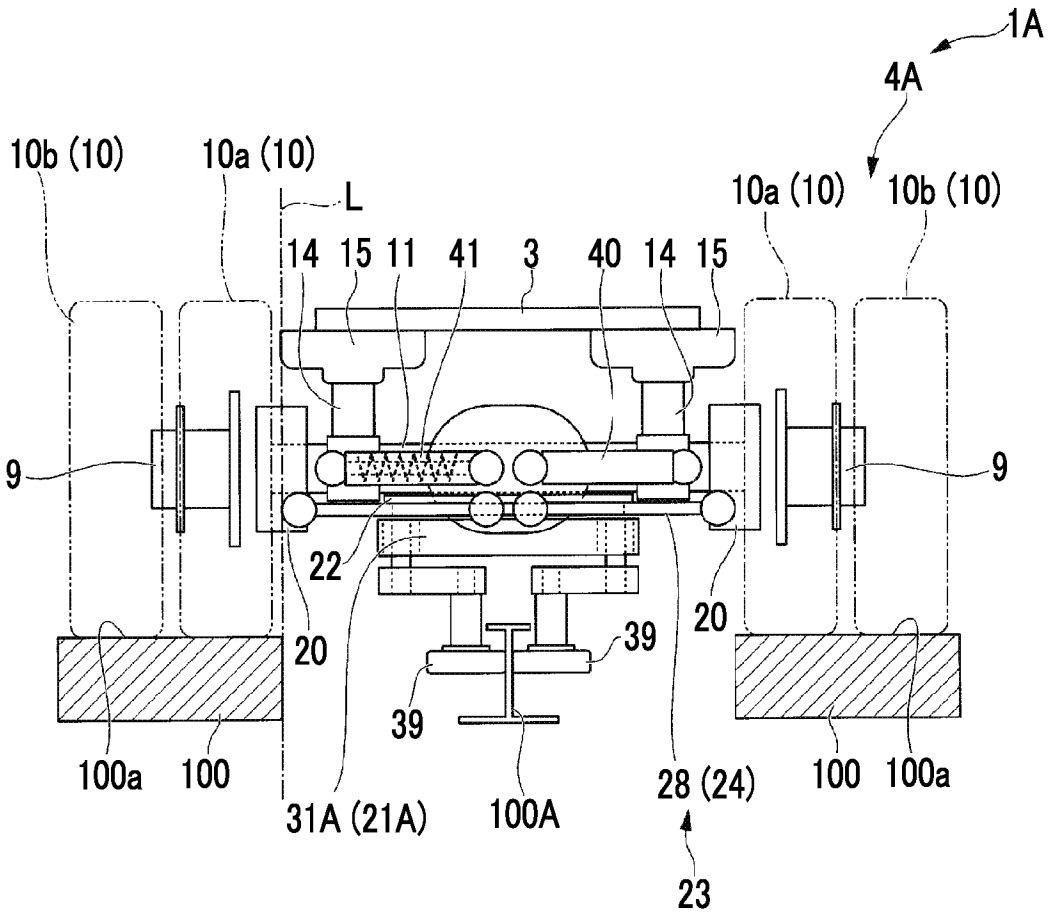
FIG. 8 is a front view illustrating the steering bogie provided at the vehicle related to the second embodiment of the invention.
Figure 9:
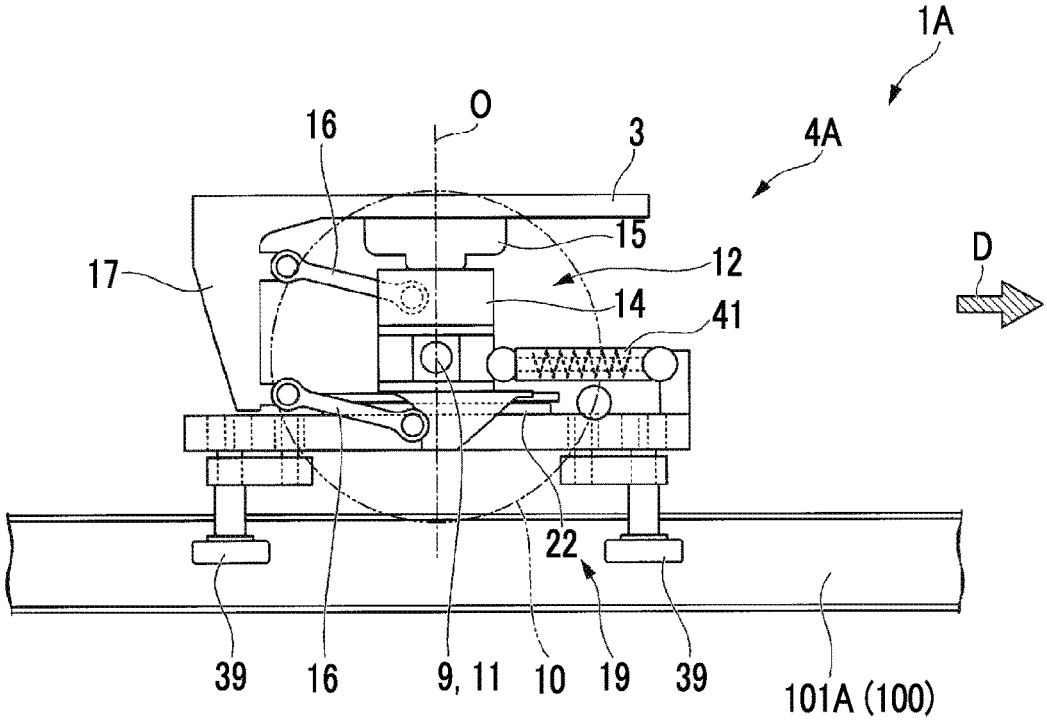
FIG. 9 is a side view illustrating the steering bogie provided at the vehicle related to the second embodiment of the invention.

As illustrated in FIGS. 7 to 9, a steering bogie 4A that the vehicle 1A of the present embodiment includes is different from the first embodiment in that the steering bogie is guided by one guide rail 101A provided at central position of the track 100 in the width direction.

That is, in the present embodiment, the vehicle 1A is a vehicle for a center guide rail type (center guide type) transportation system in which the guide rail 101A running along the extending direction of the track 100 is provided on the central position of the track 100 in the width direction.

Guide wheels in the steering bogie 4A are provided go as to sandwich one guide rail 101A provided on the track 100 from the width direction, at the central position in the width direction. The guide wheels 39, similar to the first embodiment, are provided in four places so as to sandwich the tires 10 from the front and rear, and are rotatable with a rotational axis extending to the orthogonal direction as a center.

A pair of cross beams 31A in a guide frame 21A are formed so as to be shorter in the width direction than the cross beams 31 the first embodiment, are disposed between a pair of left and right longitudinal beams 30A, and are combined with the longitudinal beams 30A.

According to the vehicle 1A of the present embodiment, even in the center guide rail type transportation system, similar to the side guide rail type, by specifying the inclination angle of the king pin 20 in the tires 10 to be steered to 0 degrees or more and 8 degrees or less and by mounting the plurality of tires 10 to an end section of each axle hub 9, it is possible to obtain sufficient load bearing performance while holding down costs.

Although the embodiments of the invention have been described above in detail, some design changes can also be made without departing from the technical idea of the invention.

For example, an alarm may be emitted at the time of an internal pressure drop or bursting, by providing an internal pressure sensor in each tire 10 to detect internal pressure.

Additionally, core-type tires 10 may be used as the tires 10.

Moreover, the tires may be not the dual tires but triple tires or the like, and the number of tires 10 mounted on each axle hub 9 is not limited in the case of the above-described embodiments.

Additionally, in the above-described embodiments, a structure may be adopted in which the guide wheels 39 are provided so as to sandwich the tires 10 from the front and rear thereof and the steering type is combined with the bogie type. However, for example, steering carriages of a type in which a guide wheel 39 is provided only in front of the tires 10 and the turning bearing 22 is not provided may be used as the steering bogies 4 and 4A.

INDUSTRIAL APPLICABILITY

In the above steering bogie and the above vehicle for the track-based transportation system, a plurality of tires is mounted on an end section of each axle hub, so that sufficient load bearing performance can be obtained while holding down costs.

REFERENCE SIGNS LIST

1, 1A: VEHICLE
2: CARBODY
3: UNDERFRAME
4 (4*a*, 4*b*), 4A: STEERING BOGIE
9: AXLE HUB
10: TIRE
11: STEERING SHAFT
12: SUSPENSION DEVICE
14: SPRING RECEIVER
15: AIR SPRING
16: PARALLEL LINK
17: SUSPENSION FRAME
19: GUIDE DEVICE PART
20: KING PIN
21, 21A: GUIDE FRAME
22: TURNING BEARING
23: STEERING MECHANISM
24: STEERING MEMBER
27: STEERING ARM
28: STEEPING ROD
30, 30A: LONGITUDINAL BEAM
31, 31A: CROSS BEAM
39: GUIDE WHEEL
39*a*: SWITCHING GUIDE WHEEL
40: HORIZONTAL DAMPER
41: STEERING STABILIZER
100: TRACK
100*a*: TRAVELING ROAD SURFACE
101, 101A: GUIDE RAIL
O: TURNING CENTER

The invention claimed is:

1. A steering bogie comprising:

a steering shaft provided at a lower part of a carbody of a vehicle for a track-based transportation system traveling on a traveling road surface of a track;

shaft-like king pins provided in a pair at end sections of the steering shaft on both sides of the carbody in a width direction;

axle hubs provided so as to be swingable with respect to the steering shaft via the king pins;

a plurality of tires mounted on each of the axle hubs;

guide wheels that roll on guide rails provided at the track in an extending direction of the track and that are guided from the width direction of the track;

a guide device part that supports the guide wheels and the steering shaft; and a steering mechanism that causes the axle hubs to rotate around the king pins in accordance with the displacement of the guide device part, wherein the guide wheels are supported by the guide device part in front of and behind the tires, wherein the guide device part includes a guide frame that supports the guide wheels and is provided so as to be turnable with respect to the carbody, wherein the steering mechanism includes a steering member that is installed between each of the axle hubs and the guide frame and steers the plurality of tires in accordance with the displacement of the guide frame, wherein the king pins are provided at an inclination angle of 0 degrees or more and 1 degree or less on a basis of a vertical line orthogonal to a traveling direction and the width direction of the carbody, and wherein the axle hubs are provided to have the inclination angle.

2. The steering bogie according to claim 1, wherein in the king pin, spacing between a central position, on the traveling road surface, of a tire width that is a distance between an inside end surface in a tire located on an innermost side in the width direction among the plurality of tires in a same axle hub, and an outside end surface in a tire located on an outermost side in the width direction, and a point where a central axis of the king pin intersects the traveling road surface is 50 mm or more and 350 mm or less.

3. The steering bogie according to claim 1, wherein, in the plurality of tires in the same axle hub, air pressure is higher in the tire provided on a side away from the king pin than in the tire provided on a king pin side.

4. The steering bogie according to claim 1, wherein, in the plurality of tires in the same axle hub, dimension of the tire width is larger in the tire provided on a side away from the king pin than in the tire provided on a king pin side.

5. The steering bogie according to claim 1, wherein, in the plurality of tires in the same axle hub, dimension of tire diameter is larger in the tire provided on a side away from the king pin than in the tire provided on a king pin side.

6. The steering bogie according to claim 1, wherein the guide wheels are guided by the guide rails provided in a pair on both sides of the track in the width direction.

7. The steering bogie according to claim 1, wherein the guide wheels are guided by one guide rail provided on at a central position of the track in the width direction.

8. A vehicle for a track-based transportation system comprising: the steering bogie according to claim 1; and a carbody having the steering bogie provided at a ower part thereof.

* * * * *